US011223153B2

(12) United States Patent
Miyakawa et al.

(10) Patent No.: US 11,223,153 B2
(45) Date of Patent: Jan. 11, 2022

(54) CONNECTOR HOUSING HAVING LANCE WITH CLEARANCE PORTION

(71) Applicant: YAZAKI CORPORATION, Tokyo (JP)

(72) Inventors: Tomoyuki Miyakawa, Utsunomiya (JP); Masaki Tanaka, Utsunomiya (JP)

(73) Assignee: YAZAKI CORPORATION, Tokyo (JP)

( * ) Notice: Subject to any disclaimer, the term of this patent is extended or adjusted under 35 U.S.C. 154(b) by 84 days.

(21) Appl. No.: 16/802,560

(22) Filed: Feb. 27, 2020

(65) Prior Publication Data

US 2020/0313336 A1 Oct. 1, 2020

(30) Foreign Application Priority Data

Mar. 28, 2019 (JP) ..... JP2019-063332

(51) Int. Cl.
*H01R 13/422* (2006.01)
*H01R 13/436* (2006.01)
*H01R 13/627* (2006.01)

(52) U.S. Cl.
CPC ..... *H01R 13/4223* (2013.01); *H01R 13/4362* (2013.01); *H01R 13/627* (2013.01)

(58) Field of Classification Search
CPC .. H01R 13/4223; H01R 13/4361–4368; H01R 13/627
See application file for complete search history.

(56) References Cited

U.S. PATENT DOCUMENTS

| | | | | |
|---|---|---|---|---|
| 6,655,993 | B1 | 12/2003 | Yamamoto | |
| 9,172,171 | B2 * | 10/2015 | Nemoto | H01R 13/424 |
| 10,461,456 | B2 * | 10/2019 | Mochizuki | H01R 13/4223 |
| 2002/0081913 | A1 | 6/2002 | Tabata et al. | |
| 2002/0127914 | A1 | 9/2002 | Yamamoto | |
| 2013/0157522 | A1 * | 6/2013 | Kobayashi | H01R 13/426 439/865 |
| 2014/0024242 | A1 * | 1/2014 | Nagasaka | H01R 13/434 439/350 |
| 2018/0316116 | A1 * | 11/2018 | Mochizuki | H01R 13/4223 |

FOREIGN PATENT DOCUMENTS

| | | | |
|---|---|---|---|
| CN | 103098311 | A | 5/2013 |
| JP | 2000-294340 | A | 10/2000 |
| JP | 2002-190337 | A | 7/2002 |
| JP | 2012-84404 | A | 4/2012 |

* cited by examiner

*Primary Examiner* — Edwin A. Leon
*Assistant Examiner* — Milagros Jeancharles
(74) *Attorney, Agent, or Firm* — Kenealy Vaidya LLP

(57) ABSTRACT

A housing includes a terminal accommodating chamber and a lance. The lance includes a locking portion configured to lock the abutting edge of the terminal, a clearance portion, and a boundary portion between the locking portion and the escape portion. The locking portion is provided on one side of the boundary portion toward which the lance deflects in the first direction, and the clearance portion being provided on another side of the boundary portion toward which the lance returns in the second direction. An edge of the locking portion on a side opposite to the boundary portion and an edge of the clearance portion on a side opposite to the boundary portion are disposed away from the boundary portion toward the rear side of the housing from which the terminal is inserted.

3 Claims, 10 Drawing Sheets

CONNECTOR HOUSING HAVING LANCE WITH CLEARANCE PORTION

CROSS REFERENCE TO RELATED APPLICATIONS

This application claims priority to Japanese Patent Application No. 2019-063332 filed on Mar. 28, 2019, the content of which is incorporated herein by reference.

BACKGROUND

Field of the Invention

The present invention relates to a housing.

Related Art

A related art housing is for a connector, and includes a terminal accommodating chamber which accommodates a terminal and a lance which locks a rear end of the terminal inserted into the terminal accommodating chamber to retain the terminal (see, for example, JP-2012-84404-A and JP-2000-294340-A).

When an electric wire connected to the terminal is pulled, the lance which locks the terminal may be deformed and force for locking the terminal may decrease. Rigidity of the lance may be increased to address this, but the increased rigidity necessitates higher force for inserting the terminal, and makes the assembling work difficult.

SUMMARY

Illustrative aspects of the present invention provide a housing with a more reliable locking of a terminal while ensuring efficient assembling work.

According to an illustrative aspect of the present invention, a housing includes a terminal accommodating chamber configured to accommodate a terminal inserted from a rear side of the housing, the terminal having an abutting portion at a rear end of the terminal; and a lance configured to deflect in a first direction when the terminal is inserted into the terminal accommodating chamber and pushes the lance out of the terminal accommodating chamber, and to return in a second direction when the terminal is further inserted to lock the abutting portion of the terminal at a distal end portion of the lance, the distal end portion of the lance including: a locking portion configured to lock the abutting portion of the terminal; a clearance portion, and a boundary portion between the locking portion and the clearance portion, the locking portion being provided on one side of the boundary portion toward which the lance deflects in the first direction, and the clearance portion being provided on another side of the boundary portion toward which the lance returns in the second direction. An edge of the locking portion on a side opposite to the boundary portion and an edge of the clearance portion on a side opposite to the boundary portion are disposed away from the boundary portion toward the rear side of the housing from which the terminal is inserted.

Other aspects and advantages of the invention will be apparent from the following description, the drawings and the claims.

DETAILED DESCRIPTION OF THE EXEMPLARY EMBODIMENTS

Specific embodiments according to the present invention will be described below with reference to the drawings.

Figure 1:
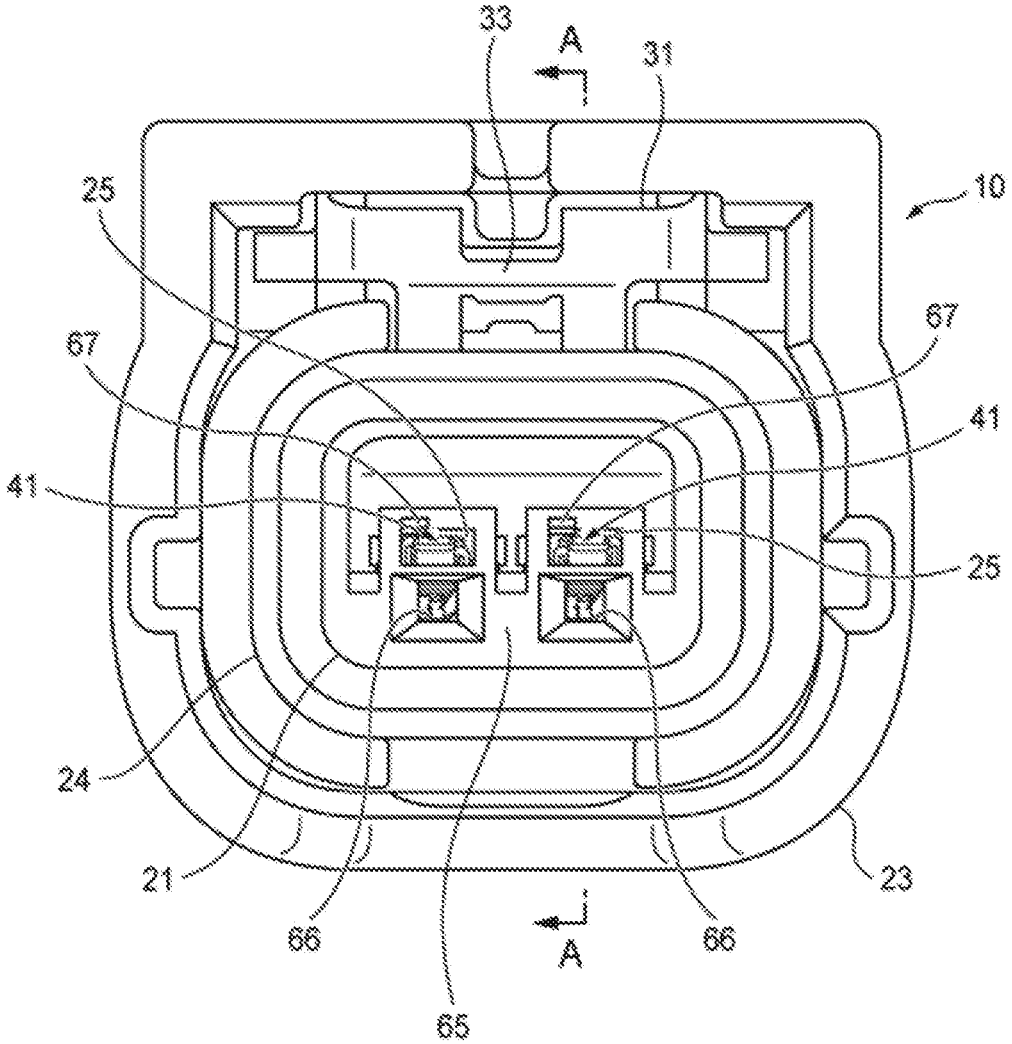
FIG. 1 is a front view of a housing according to an embodiment of the present invention.
Figure 2:
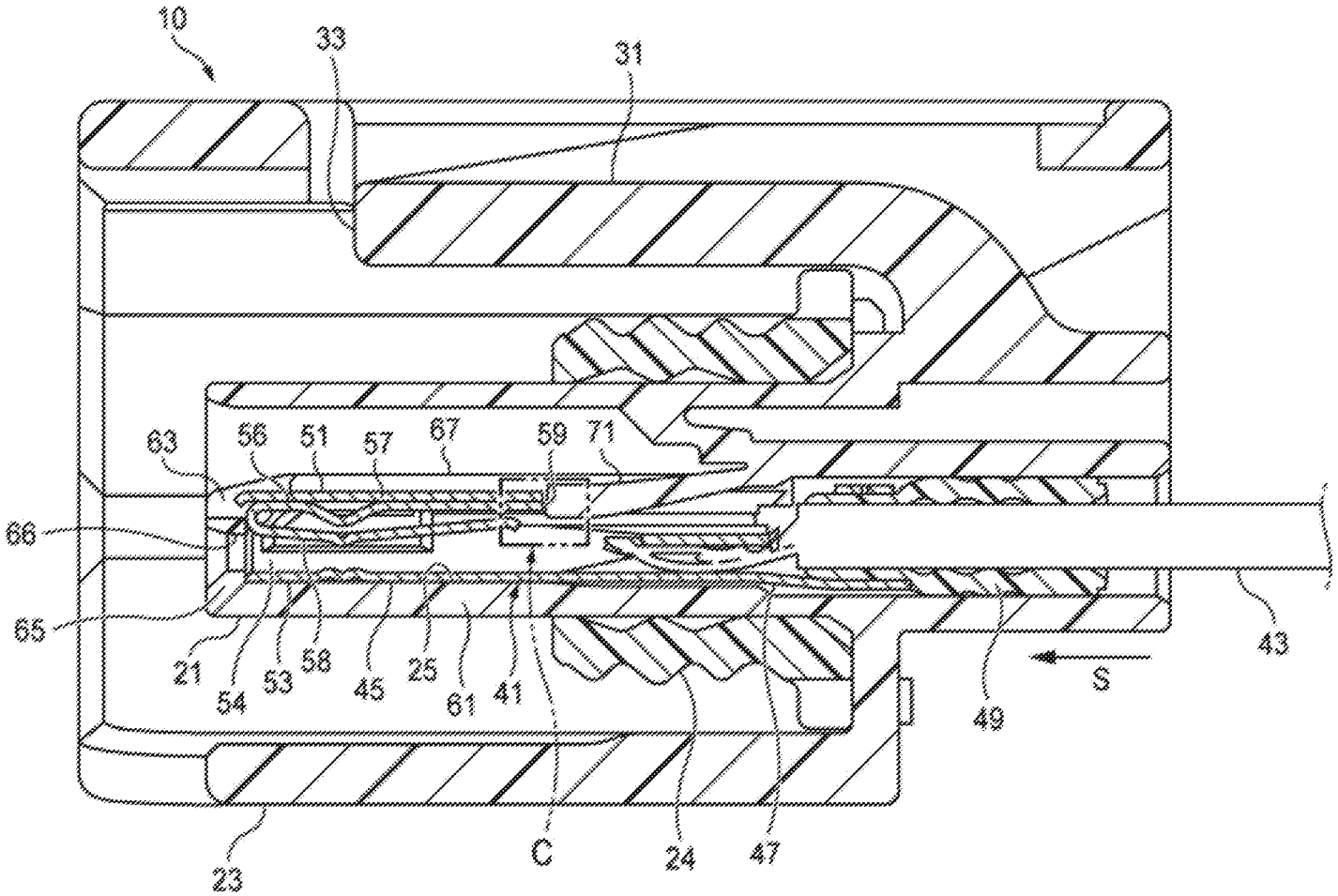
FIG. 2 is a cross-sectional view taken along a line A-A in FIG. 1.

FIG. 1 is a front view of a housing 10 according to the present embodiment. FIG. 2 is a cross-sectional view taken along line A-A in FIG. 1. As shown in FIG. 1 and FIG. 2, the housing 10 according to the present embodiment is a female housing that accommodates two female terminals (terminals) 41. The housing 10 is made of synthetic resin. The housing 10 includes a cylindrical inner housing 21 and a cylindrical outer housing 23 that is spaced apart from and surrounds an outer peripheral surface of the inner housing 21. The inner housing 21 and the outer housing 23 are formed integrally. A seal member 24 is equipped to an outer peripheral surface of a root of the inner housing 21. A hood portion of a male housing (not shown) is inserted into a gap between the outer peripheral surface of the inner housing 21 and an inner peripheral surface of the outer housing 23, and the hood portion of the male housing tightly contact with the seal member 24 to seal the gap.

The housing 10 includes an elastically deformable cantilever-shaped lock arm 31. The lock arm 31 includes a locking portion 33 at a distal end, and the locking portion 33 can swing with a rear end as a fulcrum. When the housing 10 is fitted to the mating male housing (not shown), the lock arm 31 locks a locking projection (not shown) of the male housing with the locking portion 33. Accordingly, the housing 10 is locked in a state of being fitted to the male housing.

The inner housing 21 includes two terminal accommodating chambers 25 into which the female terminals 41 are inserted. Each of the terminal accommodating chambers 25 is opened to the outside at a front end of the inner housing 21, and a tab-shaped male terminal (not shown) provided in the male housing is inserted from the front side of the inner housing 21.

The female terminal 41 is connected to an end portion of an electric wire 43. The female terminal 41 includes an electrical connecting portion 45 that is configured to be electrically connected to the male terminal when the male terminal is inserted, and an electric wire connecting portion 47 that is crimped to an end portion of the electric wire 43 and electrically connected to a conductor of the electric wire 43. The end portion of the electric wire 43 connecting to the female terminal 41 is equipped with a rubber plug 49. The rubber plug 49 is fitted into the terminal accommodating chamber 25 to seal the terminal accommodating chamber 25.

An electrical connecting portion 45 of the female terminal 41 includes a square tube-shaped box portion 51. The box portion 51 includes a rear end on an opposite side of the inner housing 21 from the front side from which the tab is inserted, and the rear end of the box portion 51 is connected to the electric wire connecting portion 47.

The box portion 51 includes a bottom plate 53, side plates 54, and upper plates 56 and 57. The upper plates 56 and 57 are formed by bending the side plates 54 separately, and are overlapped with each other so as to block an upper side of the box portion 51. A spring contact 58 is provided in upper part within the box portion 51. The spring contact 58 is connected to a front end of the upper plate 56 disposed inside the box portion 51 and is folded back to the rear end of the box portion 51.

The tab of the male terminal is inserted into the box portion 51 from a front side thereof. Then, the tab enters between the bottom plate 53 and the spring contact 58, and the spring contact 58 contacts an outer surface of the tab with its elastic force. Thus, the female terminal 41 and the male terminal are electrically connected.

The upper side of the rear end of the box portion 51 protrudes upward with respect to the electric wire connecting portion 47 of the female terminal 41. The rear end of the box portion 51 protruding upward is provided with an abutting portion 59. The abutting portion 59 is formed of an edge of the upper plate 57 and projects slightly toward a rear end of the female terminal 41.

Figure 3:
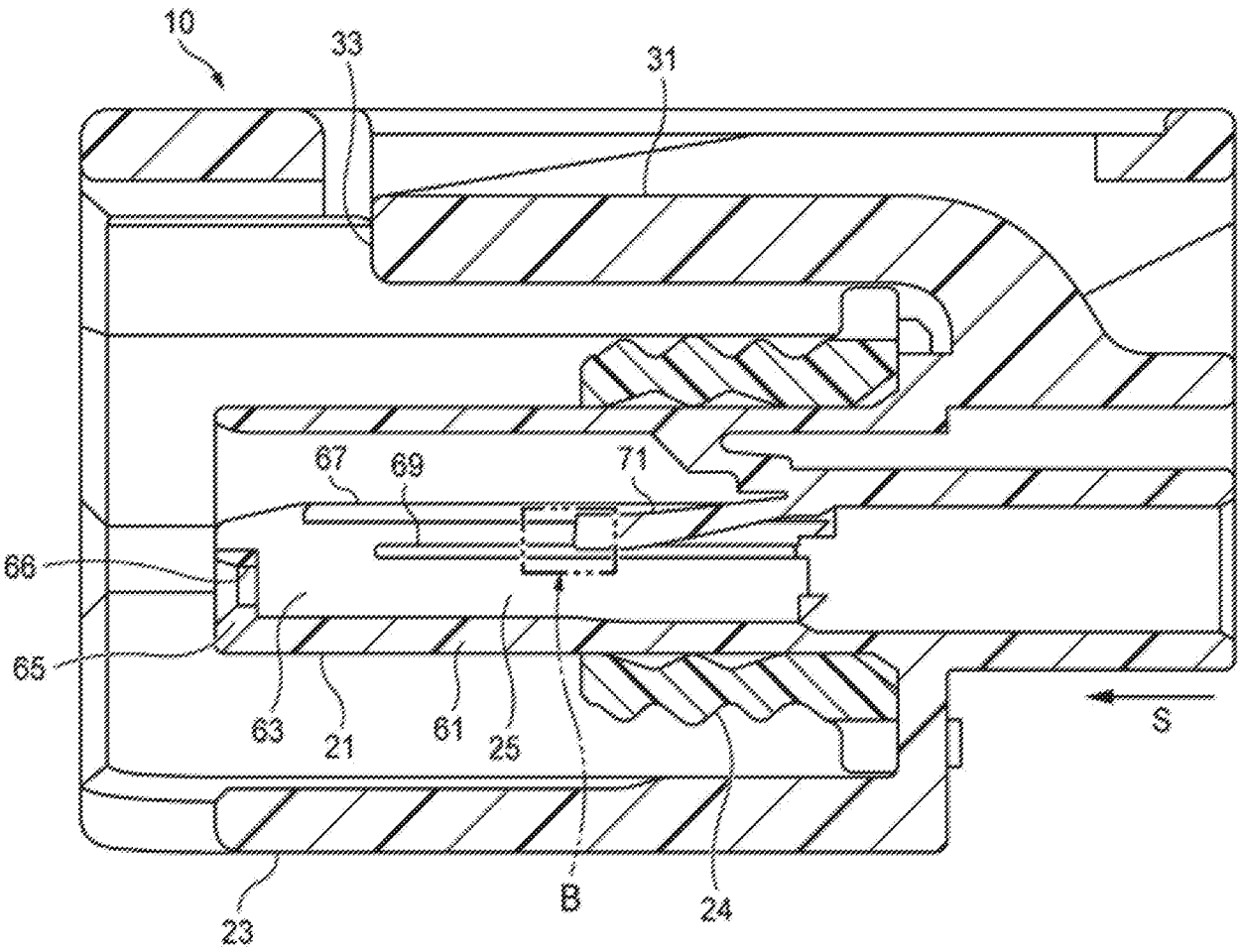
FIG. 3 is a cross-sectional view taken along a line A-A in FIG. 1 before a terminal is inserted.
Figure 4:
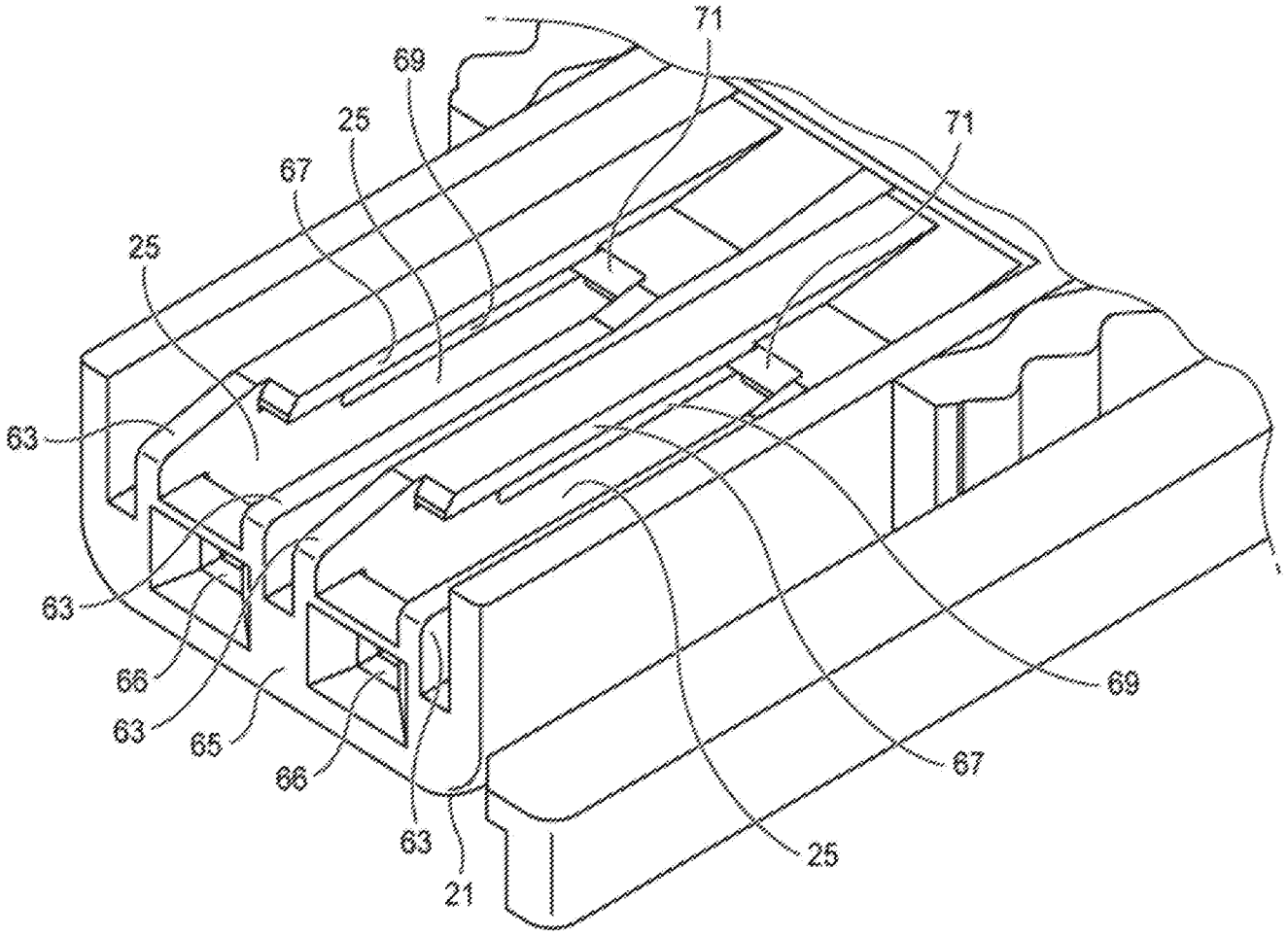
FIG. 4 is a perspective view showing a terminal accommodating chamber of the housing shown in FIG. 1.
Figure 5:
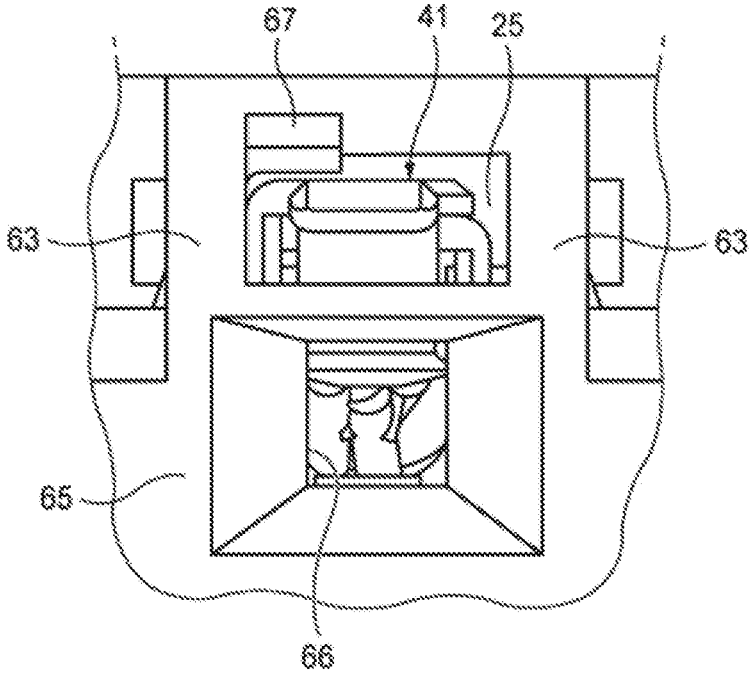
FIG. 5 is a front view of the terminal accommodating chamber shown in FIG. 4.
Figure 6:
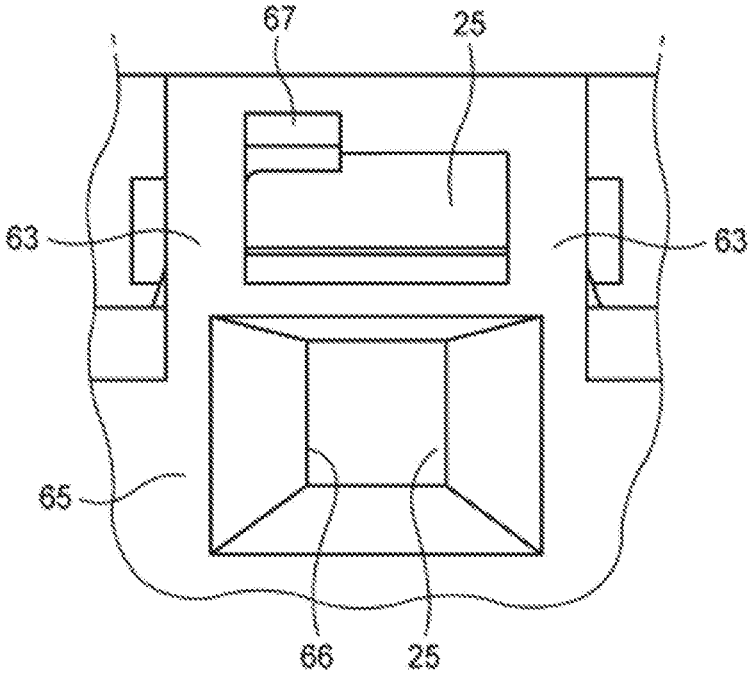
FIG. 6 is a front view of the terminal accommodating chamber shown in FIG. 4 before the terminal is inserted.

FIG. 3 is a cross-sectional view taken along line A-A in FIG. 1 before the female terminal 41 is inserted. FIG. 4 is a perspective view showing the terminal accommodating chamber 25 of the inner housing 21. FIG. 5 is a front view of the terminal accommodating chamber 25. FIG. 6 is a front view of the terminal accommodating chamber 25 before the female terminal 41 is inserted.

As shown in FIG. 3 to FIG. 6, the terminal accommodating chamber 25 of the inner housing 21 has a groove shape formed by a bottom wall 61 and a pair of side walls 63. A front wall 65 is disposed at a front end of the terminal accommodating chamber 25, and is provided with an insertion port 66 through which the male terminal is inserted. A terminal presser 67 protrudes from an upper edge of one of the side walls 63. The terminal presser 67 extends along an insertion direction S of the female terminal 41. A space surrounded by the bottom wall 61, the side walls 63, and the terminal presser holder 67 serves as an accommodating space of the terminal accommodating chamber 25, and the box portion 51 of the female terminal 41 is accommodated in the accommodating space.

The terminal accommodating chamber 25 is provided with a lance 71 on a rear side thereof. A rear end of the lance 71 is formed integrally with the inner housing 21, and a distal end of the lance 71 extends toward the inside of the terminal accommodating chamber 25. The distal end of the lance 71 is directed forward in the insertion direction S of the female terminal 41 and is disposed in an upper part within the rear end of the terminal accommodating chamber 25.

The lance 71 is formed integrally with the terminal presser 67 forming a part of the terminal accommodating chamber 25. Further, one of the side walls 63 provided with the terminal presser 67 is provided with a slit 69. The slit 69 is arranged near the terminal presser 67 and is formed parallel to the terminal presser 67 along the insertion direction S of the female terminal 41.

Figure 7:
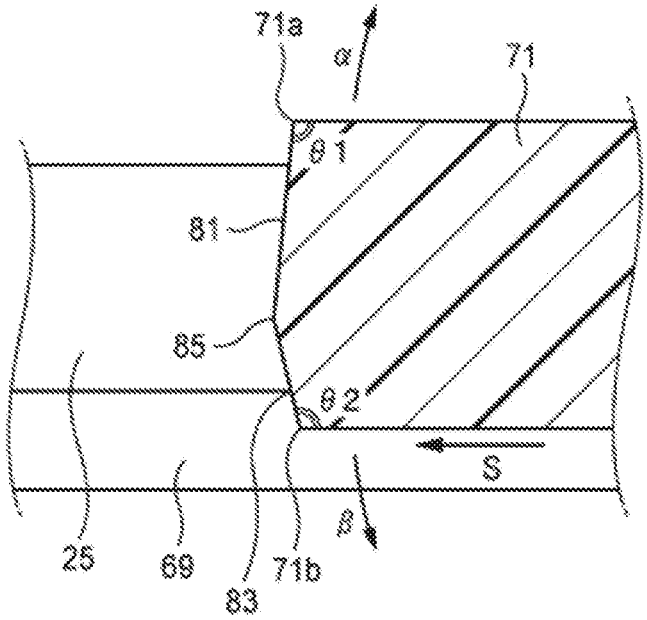
FIG. 7 is an enlarged view of part B in FIG. 3.
Figure 8A:
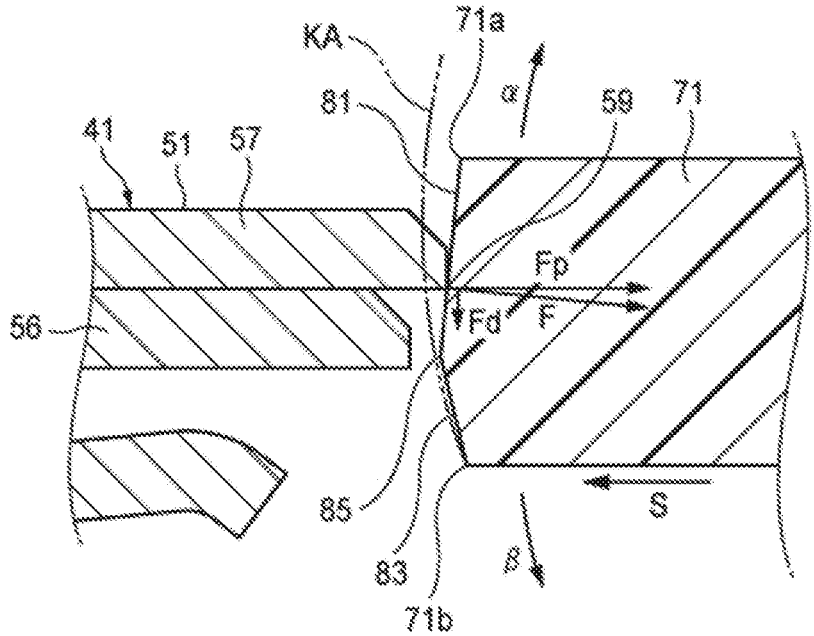
FIG. 8A and FIG. 8B are enlarged views of part C in FIG. 2, and show a locking section in which a female terminal is locked by the lance.
Figure 8B:
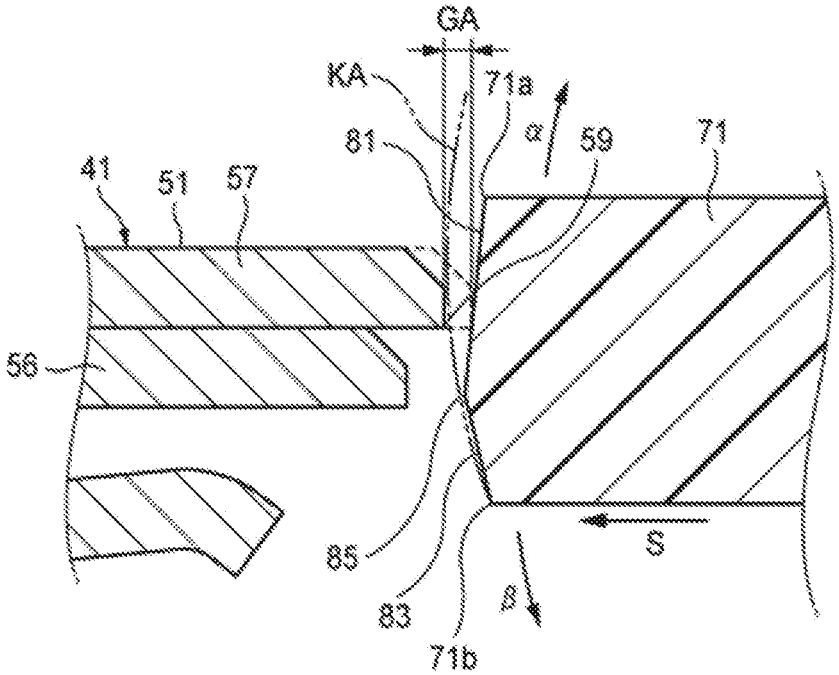

FIG. 7 is an enlarged view of part B in FIG. 3. FIG. 8A and FIG. 8B are enlarged views of part C in FIG. 2.

As shown in FIGS. 7 and 8A, the lance 71 includes a locking portion 81, a clearance portion 83, and a boundary portion 85 between the locking portion 81 and the clearance portion 83 at the distal end thereof. The lance 71 is configured to deflect in a first direction α when the box portion 51 of the female terminal 41 is inserted into the terminal accommodating chamber 25 and pushes the lance 71 out of the terminal accommodating chamber 25, and is configured to return in the second direction β to lock the abutting portion 59 of the female terminal 41 when the box portion 51 of the female terminal 41 is further inserted into the terminal accommodating chamber 25 and the abutting portion 59 of the female terminal 41 gets over the lance 71.

The locking portion 81 includes an inclined surface inclined rearward in the insertion direction S of the female terminal 41 and outward from the inside of the terminal accommodating chamber 25. Thus, the inclined surface of the locking portion 81 is formed at an angle θ1 greater than 90° with respect to an upper surface of the lance 71. The clearance portion 83 includes an inclined surface inclined forward in the insertion direction S of the female terminal 41 and outward from the inside of the terminal accommodating chamber 25. Thus, the inclined surface of the clearance portion 83 is formed at an angle θ2 greater than 90° with respect to a lower surface of the lance 71. The boundary portion 85 between the locking portion 81 and the clearance portion 83 protrudes forward in the insertion direction S, and an upper edge 71*a* of the lance 71 adjacent to the locking portion 81 and a lower edge 71*b* of the lance 71 adjacent to the clearance portion 83 are disposed rearward with respect to the boundary portion 85 in the insertion direction S.

When the female terminal 41 is accommodated in the terminal accommodating chamber 25, the abutting portion 59 of the female terminal 41 is disposed in front of the lance 71. The abutting portion 59 is disposed above the boundary portion 85.

Next, a process in which the female terminal 41 is inserted into the terminal accommodating chamber 25 is described.

The female terminal 41 connected to the electric wire 43 is inserted into the terminal accommodating chamber 25 of the housing 10 from the rear side of the housing 10. The box portion 51 of the female terminal 41 inserted into the terminal accommodating chamber 25 abuts the lance 71, and pushes up the lance 71 outward from the terminal accommodating chamber 25, then the lance 71 is elastically deformed. Specifically, the lance 71 is elastically deformed so as to deflect in a first direction α with the root integrally formed with the inner housing 21 as a fulcrum.

When the female terminal 41 is further inserted to a hack of the terminal accommodating chamber 25 and the abutting portion 59 of the box portion 51 gets over the lance 71, the pushed-up lance 71 is released. Then, the elastically-deformed lance 71 is restored. Specifically, the lance 71 returns in the second direction β. The distal end portion of the lance 71 has the clearance portion 83 that includes an inclined surface inclined forward in the insertion direction S of the female terminal 41 and outward from the inside of the terminal accommodating chamber 25. Therefore, a radius of a rotation trajectory KA (indicated by a two-dot chain line in FIGS. 8A and 8B), on which the lower edge portion 71*b* moves when the lance 71 returns in the second direction β, is reduced. This prevents the lance 71 from being caught by the abutting portion 59 of the female terminal 41.

When the lance 71 returns, the distal end portion of the lance 71 enters the rear of the abutting portion 59 of the female terminal 41, and the abutting portion 59 is disposed above the boundary portion 85 and opposite to the locking portion 81. Thus, the female terminal 41 is locked by the lance 71.

In the locked state of the female terminal 41, the abutting portion 59 abuts the locking portion 81 of the lance 71, so that the female terminal 41 is prevented from coming off from the terminal accommodating chamber 25.

In the locked state of the female terminal 41, when the electric wire 43 is pulled and a pulling force is applied to the female terminal 41 in a pull-out direction in which the female terminal 41 is pulled out of the terminal accommodating chamber 25, a pull-out force F acts perpendicularly on an abutting spot of the locking portion 81 of the lance 71, which is the inclined surface, abutting the abutting portion 59. Then, a pushing force Fp along the pull-out direction of the female terminal 41 and a push-down force Fd perpendicular to the pull-out direction toward the inside of the terminal accommodating chamber 25, which are component forces of the pull-out force F, act on the lance 71. Thus, the lance 71 is pushed down by the push-down force Fd in the second direction β toward the inside of the terminal accommodating chamber 25, and is displaced in a direction of locking the box portion 51 of the female terminal 41 more. This increases an engaging margin between the lance 71 and the abutting portion 59 of the female terminal 41, and increases the force for locking the female terminal 41.

Since the lance 71 includes the clearance portion 83 at the distal end, the radius of the rotation trajectory KA, on which the lance 71 moves when the lance 71 returns in the second direction β, is reduced. This, as shown in FIG. 8B, makes a clearance GA between the lance 71 and the abutting portion 59 of the female terminal 41 required for the restoration of the lance 71 as small as possible.

Since the push-down force Fd acts on the lance 71, the terminal presser 67 formed integrally with the lance 71 is pushed down toward the terminal accommodating chamber 25. Thus, the box portion 51 of the female terminal 41 accommodated in the terminal accommodating chamber 25 is pushed down by the terminal presser 67 and pressed against the bottom wall portion 61. Therefore, the female terminal 41 is held in the terminal accommodating chamber 25 without rattling.

Here, lances according to Reference Examples 1 and 2 having different shapes are described.

Figure 9:
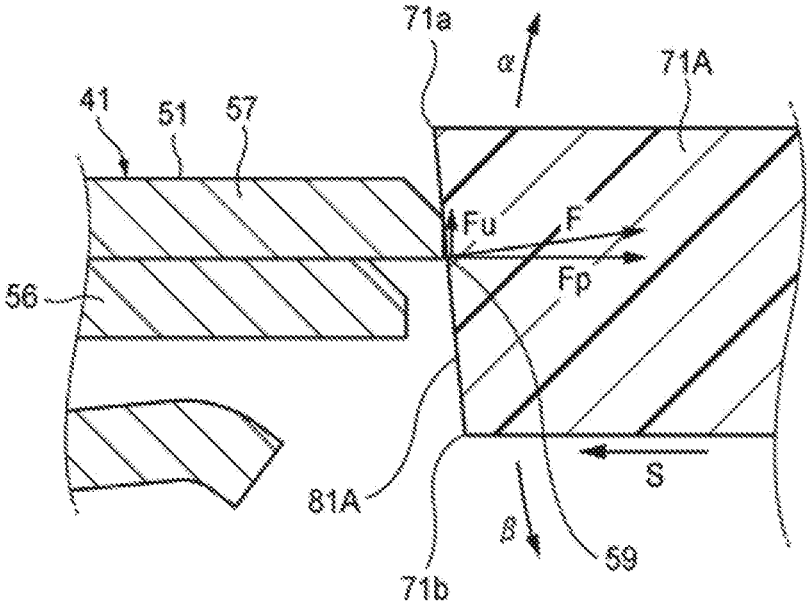
FIG. 9 is an enlarged view of a part equivalent to part C in FIG. 2 according to Reference Example 1.

FIG. 9 shows a lance 71A according to Reference Example 1. An entire distal end of the lance 71A forms a locking portion 81A which is an inclined surface inclined forward in the insertion direction S of the female terminal 41 and outward from the inside of the terminal accommodating chamber 25.

In the case of the lance 71A, when the electric wire 43 is pulled and the pull-out force F acts on an abutting spot of the locking portion 81A abutting the abutting portion 59, a pushing force Fp along the pull-out direction of the female terminal 41 and a push-up force Fu perpendicular to the pull-out direction toward the outside of the terminal accommodating chamber 25, which are component forces of the pull-out force F, act on the lance 71A. Thus, the lance 71A may be pushed up by the push-up force Fu in the first direction α toward the outside of the terminal accommodating chamber 25, and displaced away from the box portion 51 of the female terminal 41. This may decrease an engaging margin between the lance 71A and the abutting portion 59 of the female terminal 41, and decrease the force for locking the female terminal 41.

Figure 10A:
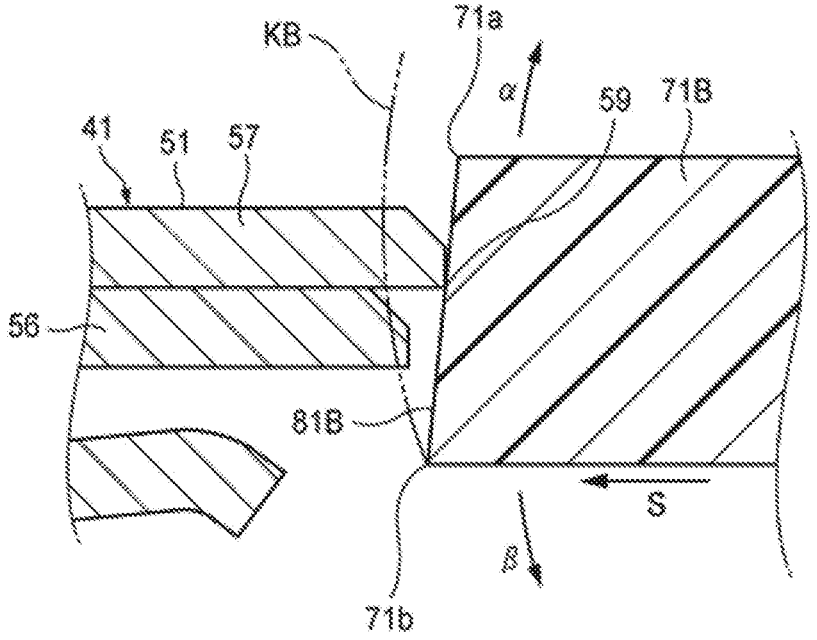
FIG. 10A and FIG. 10B are enlarged views of a part equivalent to part C in FIG. 2 according to Reference Example 2.
Figure 10B:
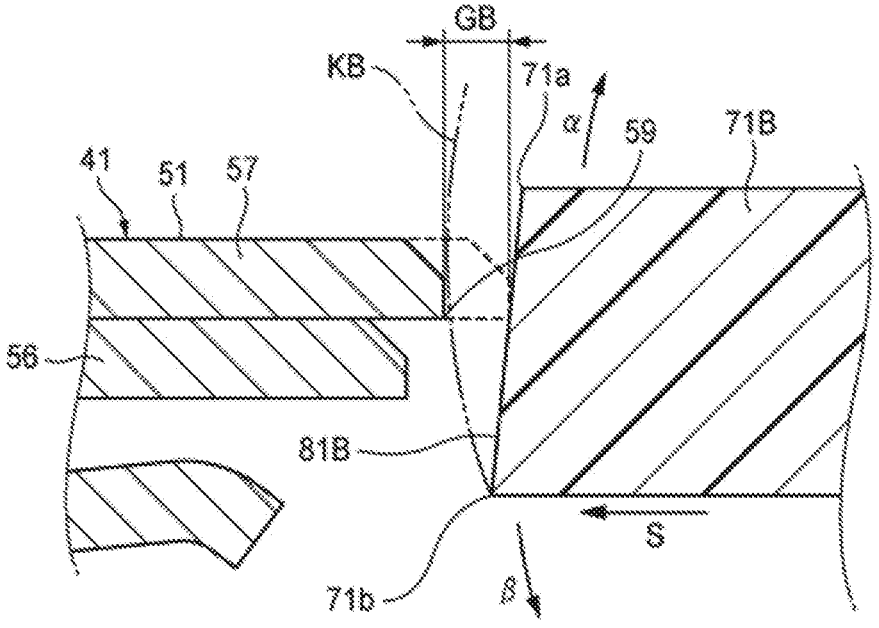

FIGS. 10A and 10B show a lance 71B according to Reference Example 2. An entire distal end of the lance 71B forms a locking portion 81B which is an inclined surface inclined rearward in the insertion direction S of the female terminal 41 and outward from the inside of the terminal accommodating chamber 25.

In the case of the lance 71B, when the electric wire 43 is pulled and the pull-out force F acts on the abutting spot of the locking portion 81B abutting the abutting portion 59, a pushing force Fp along the pull-out direction of the female terminal 41 and a push-down force Fd perpendicular to the pull-out direction toward the inside of the terminal accommodating chamber 25, which are component forces of the pull-out force F, act on the lance 71B. Therefore, similarly to the lance 71 of the housing 10 according to the present embodiment, the lance 71B is pushed down by the push-down force Fd in the second direction β toward the inside of the terminal accommodating chamber 25, and is displaced in a direction of locking the box portion 51 of the female terminal 41 more, thereby the force for locking the female terminal 41 increases.

However, in the lance 71B according to Reference Example 2, the entire distal end of the lance 71B is an inclined surface inclined rearward in the insertion direction S of the female terminal 41 and outward from the inside of the terminal accommodating chamber 25. Then, a radius of a rotation trajectory KB (indicated by a two-dot chain line in FIGS. 10A and 10B) of the lower edge portion 71*b* of the lance 71B increases. This may cause the lance 71B to be caught by the box portion 51 of the female terminal 41 inserted into the terminal accommodating chamber 25, and interfere with locking of the female terminal 41. Further, in order to prevent the lower edge portion 71*b* of the lance 71B from being caught by the box portion 51, the lance 71B can be disposed rearward, and in this case, a gap between the box portion 51 of the female terminal 41 accommodated in the terminal accommodating chamber 25 and the locking portion 81B of the lance 71B increases. This may increase the rattling of the female terminal 41 along the insertion direction S.

That is, since the lance 71B has no clearance portion 83 at the distal end, the radius of the rotation trajectory KB, on which the lance 71B moves when the lance 71B returns in the second direction β, increases. Therefore, as shown in FIG. 10B, a large clearance GB between the lance 71B and the abutting portion 59 of the female terminal 41 is required for the restoration of the lance 71B. For example, when the housing with the large clearance GB is mounted on an automobile or the like, the female terminal 41 moves much forward and rearward in the terminal accommodating chamber 25 due to vibration, and connection reliability with the male terminal may be lowered.

As described above, according to the housing 10 of the present embodiment, since the locking portion 81 includes the inclined surface extending from the boundary portion 85 to the upper edge 71*a*, the push-down force Fd, which is a component force of the pull-out force F, acts as a return force in the second direction β on the lance 71 when the pull-out force F is applied to the locking portion 81 by the abutting portion 59 of the female terminal 41. Therefore, the lance 71 returns in the second direction β in which the locking force increases without deflecting in the first direction α in which the locking force decreases. Thus, the engaging margin between the lance 71 and the abutting portion 59 of the female terminal 41 increases, and the locking force applied to female terminal 41 increases without lowering efficiency of assembling work due to an increase in rigidity of the lance 71.

Since the lance 71 includes the clearance portion 83 and lower edge portion 71*b* on a opposite side of the clearance portion 83 from the boundary portion 85 is disposed rearward with respect to the boundary portion 85 in the insertion direction S, the radius of the rotation trajectory of the lance 71 decreases. The clearance portion 83 includes an inclined surface extending from the boundary portion 85 to the lower edge portion 71*b*, the lance 71 returns in the second direction β without an interference between the lance 71 and the abutting portion 59 of the female terminal 41 inserted into the terminal accommodating chamber 25. Therefore, when the lance 71 deflected in the first direction α returns in the second direction β, the clearance portion 83 of the lance 71 prevents the lance 71 from being caught by the abutting portion 59 of the female terminal 41, and the lance 71 smoothly returns to reliably lock the female terminal 41.

Moreover, since the lance 71 has the clearance portion 83 at the distal end, the radius of the rotation trajectory KA, on which the lance 71 moves when the lance 71 returns in the second direction β, decreases. This makes the clearance GA between the lance 71 and the abutting portion 59 of the female terminal 41 required for the restoration of the lance 71 as small as possible. Thus, for example, even though the housing is mounted on an automobile or the like, the front-to-rear movement of the female terminal 41 in the terminal accommodating chamber 25 due to vibration is prevented as much as possible, and good connection reliability with the male terminal is maintained.

The push-down force Fd, which is the component force of the pull-out force F acting on the lance 71, is easily adjusted by changing an inclination angle θ1 of the locking portion 81 with respect to the upper surface of the lance 71. The radius of the rotation trajectory on which the clearance portion 83 moves is easily adjusted by changing an inclination angle θ2 of the clearance portion 83 with respect to the lower surface of the lance 71.

According to the housing 10 of the present embodiment, when a force toward the second direction β is applied to the lance 71 by the pull-out force F received from the female terminal 41, the terminal presser 67 connected to the lance 71 is displaced toward the terminal accommodating chamber 25. Thus, the female terminal 41 accommodated in the terminal accommodating chamber 25 is pushed down by the terminal presser 67 and pressed against the bottom wall portion 61, and is held in the terminal accommodating chamber 25 without rattling.

Moreover, the side wall portion 63 on which the terminal presser 67 is provided includes the slit 69 formed along the terminal presser 67. Therefore, the terminal presser 67 moves smoothly and surely press the female terminal 41.

The present invention is not limited to the above-described embodiments, and may be appropriately modified, improved, or the like. In addition, the material, the shape, the size, the number, the arrangement position or the like of each component in the above-described embodiment are optional and are not limited as long as the present invention can be achieved.

For example, in the above embodiments, the locking portion 81 and the clearance portion 83 includes inclined surfaces, but the locking portions 81 and the clearance portions 83 may not necessarily include inclined surfaces. In particular, the clearance portion 83 may include a recess or a notch as long as the clearance portion 83 does not interfere with the abutting portion 59 of the female terminal 41 when the lance 71 returns.

According to the embodiments of the present invention described above, a housing includes a terminal accommodating chamber (25) configured to accommodate a terminal (female terminal 41) inserted from a rear side of the housing, the terminal having an abutting portion (59) at a rear end of the terminal; and a lance (71) configured to deflect in a first direction (α) when the terminal (female terminal 41) is inserted into the terminal accommodating chamber (25) and pushes the lance (71) out of the terminal accommodating chamber (25), and to return in a second direction (β) when the terminal (female terminal 41) is further inserted to lock the abutting portion (59) of the terminal (female terminal 41) at a distal end portion of the lance (71), the distal end portion of the lance (71) including: a locking portion (81) configured to lock the abutting portion (59) of the terminal (female terminal 41); a clearance portion (83); and a boundary portion (85) between the locking portion (81) and the clearance portion (83), the locking portion (81) being provided on one side of the boundary portion (85) toward which the lance (71) deflects in the first direction (α), and the clearance portion (83) being provided on another side of the boundary portion (85) toward which the lance (71) returns in the second direction (β). An edge (upper edge portion 71*a*) of the locking portion (81) on a side opposite to the boundary portion (85) and an edge (lower edge portion 71*b*) of the clearance portion (83) on a side opposite to the boundary portion (85) are disposed away from the boundary portion (85) toward the rear side of the housing from which the terminal (female terminal 41) is inserted.

The locking portion (81) may include an inclined surface extending from the boundary portion (85) to the edge (upper edge portion 71*a*) of the locking portion (81).

The clearance portion (83) may include an inclined surface extending from the boundary portion (85) to the edge (lower edge portion 71*b*) of the clearance portion (83), and the inclined surface of the clearance portion (83) is configured such that the lance (71) returns in the second direction (β) without an interference between clearance portion (83) and the abutting portion (59) of the terminal (female terminal 41) inserted into the terminal accommodating chamber (25). The terminal accommodating chamber (25) may include: a bottom wall (61); side walls (63) on both sides of the bottom wall (61); and a terminal presser (67) provided on at least one of the side walls (63) and facing the bottom wall portion (61), and the terminal presser (67) is connected to the lance (71).

The at least one of the side walls (63) on which the terminal presser (67) is provided may have a slit (69) along the terminal presser (67).

What is claimed is:

1. A housing comprising:

a terminal accommodating chamber configured to accommodate a terminal inserted from a rear side of the housing, the terminal having an abutting portion at a rear end of the terminal; and a lance configured to deflect in a first direction when the terminal is inserted into the terminal accommodating chamber and pushes the lance out of the terminal accommodating chamber, and to return in a second direction when the terminal is further inserted to lock the abutting portion of the terminal at a distal end portion of the lance, the distal end portion of the lance including:

a locking portion configured to lock the abutting portion of the terminal;

a clearance portion; and a boundary portion between the locking portion and the clearance portion, the locking portion being provided on one side of the boundary portion toward which the lance deflects in the first direction, and the clearance portion being provided on another side of the boundary portion toward which the lance returns in the second direction, wherein an edge of the locking portion on a side opposite to the boundary portion and an edge of the clearance portion on a side opposite to the boundary portion are disposed away from the boundary portion toward the rear side of the housing from which the terminal is inserted, wherein the terminal accommodating chamber includes:

a bottom wall;

side walls on both sides of the bottom wall; and a terminal presser provided on at least one of the side walls and facing the bottom wall, and the terminal presser is connected to the lance and the terminal presser is movable with the lance in the first direction and the second direction, and wherein the terminal presser abuts the terminal when the terminal is accommodated in the terminal accommodating chamber and the lance locks the abutting portion of the terminal.

2. The housing according to claim 1, wherein the locking portion includes an inclined surface extending form the boundary portion to the edge of the locking portion.

3. The housing according to claim 1, wherein the clearance portion includes an inclined surface extending from the boundary portion to the edge of the clearance portion, and the inclined surface of the clearance portion is configured such that the lance returns in the second direction without an interference between the clearance portion and the abutting edge of the terminal inserted into the terminal accommodating chamber.

* * * * *